US008783927B2

(12) United States Patent
Claprood et al.

(10) Patent No.: US 8,783,927 B2
(45) Date of Patent: Jul. 22, 2014

(54) LIGHT RING FOR APPLIANCE CONTROL ADJUSTABLE FOR CONSOLE THICKNESS

(75) Inventors: Edward J. Claprood, West Boylston, MA (US); David C. Gill, North Providence, RI (US)

(73) Assignee: Illinois Tool Works Inc., Glenview, IL (US)

( * ) Notice: Subject to any disclaimer, the term of this patent is extended or adjusted under 35 U.S.C. 154(b) by 57 days.

(21) Appl. No.: 13/513,381

(22) PCT Filed: Jan. 11, 2011

(86) PCT No.: PCT/US2011/020753

§ 371 (c)(1), (2), (4) Date: Jun. 1, 2012

(87) PCT Pub. No.: WO2011/090844

PCT Pub. Date: Jul. 28, 2011

(65) Prior Publication Data

US 2012/0243253 A1 Sep. 27, 2012

Related U.S. Application Data

(60) Provisional application No. 61/297,131, filed on Jan. 21, 2010.

(51) Int. Cl.

| | |
|---|---|
| ***F21V 7/04*** | (2006.01) |
| ***H01L 33/00*** | (2010.01) |
| ***G05G 1/10*** | (2006.01) |
| ***H01H 19/02*** | (2006.01) |
| ***F24C 7/08*** | (2006.01) |

(52) U.S. Cl.

CPC ..... *F24C 7/082* (2013.01); *H01H 2219/0622* (2013.01); *G05G 1/105* (2013.01); *H01H 19/025* (2013.01)

USPC ..... 362/555; 362/551; 362/580; 362/581

(58) Field of Classification Search

CPC ..... F24C 7/082; H01H 19/025; H01H 2219/0622; G05G 1/105

USPC ..... 362/555, 551, 580, 581

See application file for complete search history.

(56) References Cited

U.S. PATENT DOCUMENTS 2,334,479 A * 11/1943 Creager ..... 116/310
2,693,165 A * 11/1954 Appleman ..... 116/310

(Continued)

FOREIGN PATENT DOCUMENTS

CA 1068316 A1 12/1979
DE 3602020 A1 7/1987

(Continued)

OTHER PUBLICATIONS

English language translation of DE 10 2005 032508.*

(Continued)

*Primary Examiner* — Thomas A Hollweg

(74) *Attorney, Agent, or Firm* — Mark W. Croll; Paul F. Donovan

(57) ABSTRACT

A backlight for an appliance knob provides a light pipe that may receive light from a light source fixed behind a console at a variety of different extensions permitting ready adjustment of the light pipe to fit closely behind the appliance knob with different console thicknesses and tolerances.

20 Claims, 3 Drawing Sheets

(56) References Cited

U.S. PATENT DOCUMENTS

| | | | | | |
|---|---|---|---|---|---|
| 2,732,467 | A | | 1/1956 | Slate | |
| 3,619,594 | A | * | 11/1971 | Morez | 362/140 |
| 3,740,501 | A | | 6/1973 | Kiessling et al. | |
| 4,178,493 | A | * | 12/1979 | Sauer | 200/296 |
| 4,734,918 | A | | 3/1988 | Bauer et al. | |
| 4,800,466 | A | * | 1/1989 | Bauer et al. | 362/26 |
| 4,807,091 | A | * | 2/1989 | Obata | 362/30 |
| 5,039,832 | A | * | 8/1991 | Polacek et al. | 200/317 |
| 5,093,764 | A | * | 3/1992 | Hasegawa et al. | 362/29 |
| 5,280,145 | A | * | 1/1994 | Mosier et al. | 200/313 |
| 5,288,957 | A | * | 2/1994 | Swaybill | 200/317 |
| 5,335,148 | A | * | 8/1994 | Tominaga | 362/26 |
| 5,697,689 | A | * | 12/1997 | Levine et al. | 362/26 |
| 5,988,842 | A | * | 11/1999 | Johnsen et al. | 362/551 |
| 6,092,902 | A | | 7/2000 | Weber et al. | |
| 6,224,221 | B1 | * | 5/2001 | Glienicke | 362/23 |
| 6,590,174 | B2 | * | 7/2003 | Zysnarski et al. | 200/310 |
| 6,685,327 | B2 | * | 2/2004 | Dorrie | 362/27 |
| 6,987,233 | B2 | * | 1/2006 | Cole et al. | 200/341 |
| 7,255,061 | B2 | * | 8/2007 | Denton | 116/310 |
| 7,399,098 | B2 | * | 7/2008 | Nakamoto et al. | 362/29 |
| 7,399,936 | B2 | * | 7/2008 | Hurrle | 200/313 |
| 7,507,924 | B2 | * | 3/2009 | Lorenzo et al. | 200/314 |
| 7,524,074 | B2 | * | 4/2009 | Chery et al. | 362/26 |
| 7,582,839 | B2 | * | 9/2009 | Kyowski et al. | 200/310 |
| 2002/0075668 | A1 | * | 6/2002 | Dorrie | 362/27 |
| 2005/0067268 | A1 | * | 3/2005 | Hurrle | 200/314 |
| 2006/0061286 | A1 | * | 3/2006 | Coushaine et al. | 315/76 |
| 2006/0219156 | A1 | * | 10/2006 | Denton | 116/310 |
| 2007/0193867 | A1 | * | 8/2007 | Lorenzo et al. | 200/314 |

FOREIGN PATENT DOCUMENTS

| | | | |
|---|---|---|---|
| DE | 19654651 | A1 | 7/1998 |
| DE | 29724892 | U1 | 5/2005 |
| DE | 102005032508 | A1 | 7/2006 |
| JP | 2002287840 | A | 10/2002 |

OTHER PUBLICATIONS

International Search Report and Written Opinion for PCT/US2011/020753 mailed Apr. 19, 2011.

* cited by examiner

FIG. 4
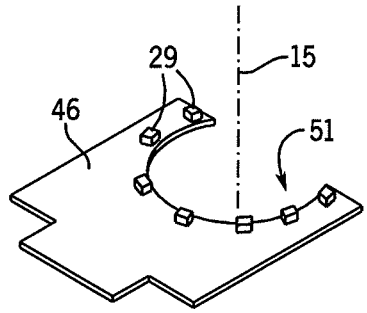
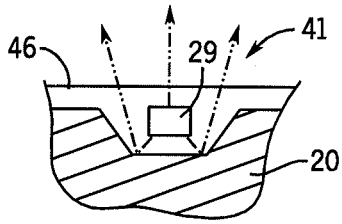
FIG. 5
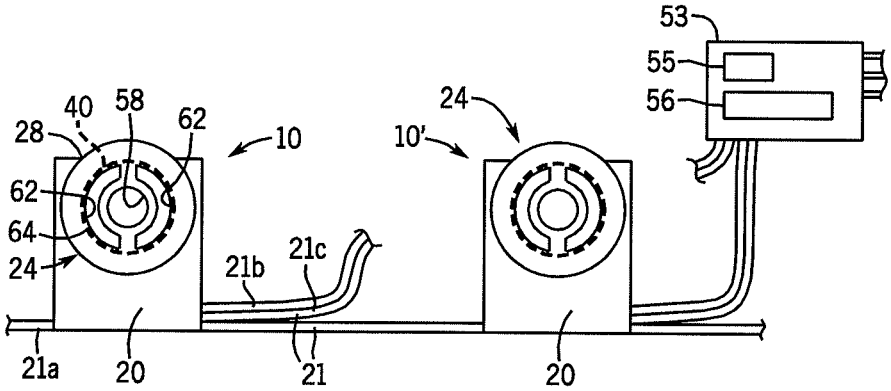
FIG. 6

FIG. 7
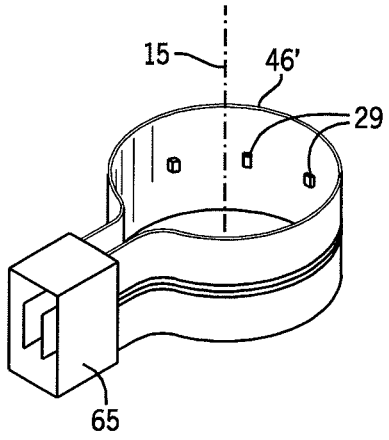
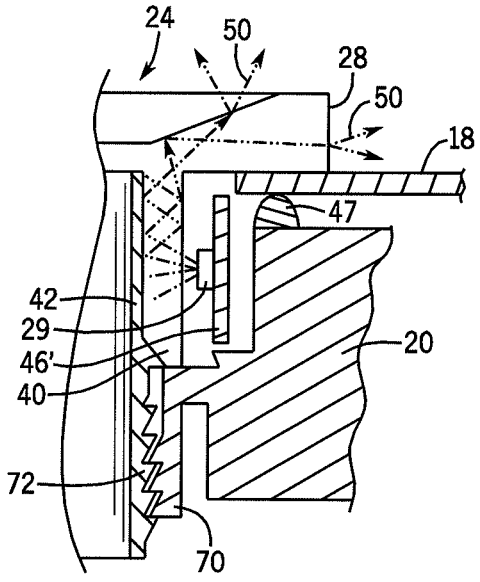
FIG. 8

LIGHT RING FOR APPLIANCE CONTROL ADJUSTABLE FOR CONSOLE THICKNESS

CROSS-REFERENCE TO RELATED APPLICATIONS

The present application is a national phase of PCT/US2011/020753, filed Jan. 11, 2011 and claims the benefits of United States Provisional Application Ser. No. 61/297,131 filed Jan. 21, 2010.

FIELD OF THE INVENTION

The present invention relates to controls for appliances such as ranges and the like and, in particular, to a lighting system for use with such appliance controls.

BACKGROUND OF THE INVENTION

Appliances, such as gas or electric ranges, may include one or more control knobs presented to the user at a console for adjusting burner heat, oven temperature or the like by operating controls positioned behind the console. Often it is desired to provide illumination of the control knobs, for example, to illuminate printed labels (indicia) indicating the status of the control, for example: low, high, medium, etc.

One method of providing this illumination is through the use of an electrical lamp, such as an LED or neon or incandescent bulb, positioned behind the console and providing light to a light pipe that may extend through the hole in the console to provide illumination near the control knob. Desirably, the electrical lamp is mounted to the rear surface of the console of the appliance to provide mechanical support for its associated wiring harness.

When a light pipe system must be used with different consoles having different thicknesses (for example sheet-metal versus glass) a light pipe fixed with respect to the front of the console experiences different separations from the electrical lamp fixed with respect to the rear of the console. This slight change in separation between these optical components can substantially change the light output of the light pipe.

SUMMARY OF THE INVENTION

The present invention provides an illumination system that allows an electrical lamp, or set of lamps such as LEDs, to be fixed with respect to a rear of the console, and the light pipe to be adjusted against the front of the console for different console thicknesses by sliding the light pipe with respect to the lamps. In one embodiment, variations in light output over this range of positioning are reduced by directing light from the electrical lamps not from the end of the light pipe but through the side of an annular light pipe. In this way, the separation distance between the electrical lamps and the light pipe remains substantially constant with different positions of the light pipe appropriate for different console thicknesses.

Specifically, the present invention provides an illuminator for an appliance control, the appliance control having a shaft that may extend through an opening in a console to be received by a knob on a front surface of the console. The illuminator includes a light pipe having a first portion adapted to fit beneath the knob on the front surface of the console with a second portion passing through the opening with the shaft and presenting a light receiving surface extending within the console. A housing positionable adjacent to the opening on a rear surface of the console may receive the second portion of the light pipe, the housing holding a plurality of electrical lamps positioned to projecting light into the light receiving surface when the light-receiving surface is so received. The second portion of the light pipe may be slidably adjusted to multiple different positions within the housing to accommodate consoles of different thickness while maintaining a substantially constant separation between the electrical lamps and the light-receiving surface.

It is thus a feature of at least one embodiment of the invention to provide a backlight for appliance knobs that may accommodate different thicknesses of consoles and thickness tolerances.

The first portion of the light pipe may provide a clamping surface abutting the front surface of the console and the second portion of the light pipe and the housing may have mutually engaging teeth permitting a clamping of the console between the clamping surface of the first portion and a front surface of the housing.

It is thus a feature of at least one embodiment of the invention to provide a self-supporting illuminator that can preserve close optical coupling between its halves.

The front surface of the housing includes a resilient pad compressible during clamping.

It is thus a feature of at least one embodiment of the invention to provide an illuminator with reduced slippage as provided by the contact of the compressible pad with the console surface to provide a more consistent clamping pressure and frictional resistance to torque.

The mutually engaging teeth may be threads.

It is thus a feature of at least one embodiment of the invention to provide a clamping action that may be readily controlled by torsion on the light pipe from the front of the console.

Alternatively, the mutually engaging teeth may be ratchet teeth and a pawl.

It is thus a feature of at least one embodiment of the invention provide a rapid assembly method when both sides of the console are readily accessible.

The light pipe may have a circular periphery encircling a central bore through which the shaft may pass.

It is thus a feature of at least one embodiment of the invention to provide a uniform illumination about a control knob to provide an improved visibility of printed indicia and the outline of the knob.

The disk may be less than or equal to the diameter of an outer periphery of the knob.

It is thus a feature of at least one embodiment of the invention to provide a backlight defining the periphery of the knob and closely spaced indicia.

The first portion of the light pipe may provide a transparent periphery and upper surface permitting light to pass therethrough.

It is thus a feature of at least one embodiment of the invention to provide a backlight that may also illuminate a translucent knob material.

The second portion of the light pipe may be a tube fitting about the shaft.

It is thus a feature of at least one embodiment of the invention to provide a light-receiving surface that may be translated and rotated while maintaining constant angle and separation with fixed lights.

The second portion of the light pipe may provide an opaque coating opposite the light-receiving surface.

It is thus a feature of at least one embodiment of the invention to provide improved light transmission efficiency for the light pipe.

The electrical lamps are light emitting diodes.

It is thus a feature of at least one embodiment of the invention to provide an illumination system that may be used with a low illumination level provided by current LEDs.

The light emitting diodes may be of two colors wired for separate control.

It is thus a feature of at least one embodiment of the invention to permit a change in color of the backlighting to signal burner activity or the like.

The electrical lamps may be supported on a planar printed circuit board fitting within the housing about an aperture receiving the second portion of the light pipe, and the electrical lamps may be positioned on the printed circuit board to direct light inward radially toward a center of the aperture.

It is thus a feature of at least one embodiment of the invention to provide a simple method of positioning multiple LEDs for uniform illumination of a light pipe.

Alternatively, the printed circuit board may be a flexible printed circuit board fitting within the housing about an aperture receiving the second portion of the light pipe, and the electrical lamps may be LEDs mounted on a surface of the printed circuit board and the printed circuit board may be formed into a ring about the aperture so that the LEDs faced inward toward the second portion of the light pipe.

It is thus a feature of at least one embodiment of the invention to provide a simple method of fabricating a ring of LEDs.

The light pipe may provide a central aperture for receiving the shaft and at least one second aperture for providing air inflow through the console.

It is thus a feature of at least one embodiment of the invention to ensure sufficient airflow if the invention is used with a mixing gas valve.

The second aperture may be within a tube forming the second portion of the light pipe.

It is thus a feature of at least one embodiment of the invention to provide both for the passage of air and light through a constrained opening.

The electrical lamps may be mounted adjacent to a reflective surface directing light toward the second portion of the light pipe.

Other features and advantages of the invention will become apparent to those skilled in the art upon review of the following detailed description, claims and drawings in which like numerals are used to designate like features.

BRIEF DESCRIPTION OF THE DRAWINGS

FIG. 4 is a perspective view of a first embodiment of the invention for supporting electrical lamps for illuminating the light pipe on a planar printed circuit board;

FIG. 5 is a fragmentary top planar cross-section of portions of the housing about the electrical lamps of FIG. 4 providing for directing reflectors;

FIG. 6 is a front elevational view of two illumination systems of the present invention as wired to each other in a daisy chain fashion and wired individually to a central controller;

FIG. 7 is a figure similar to that of FIG. 4 showing an alternative embodiment for supporting the electrical lamps on a flexible printed circuit board; and FIG. 8 is a figure similar to that of FIGS. 2 and 3 showing the electrical lamp supporting system of FIG. 7 and the use of ratchet teeth instead of threads to assemble the annular light pipe and housing.

Figure 1:
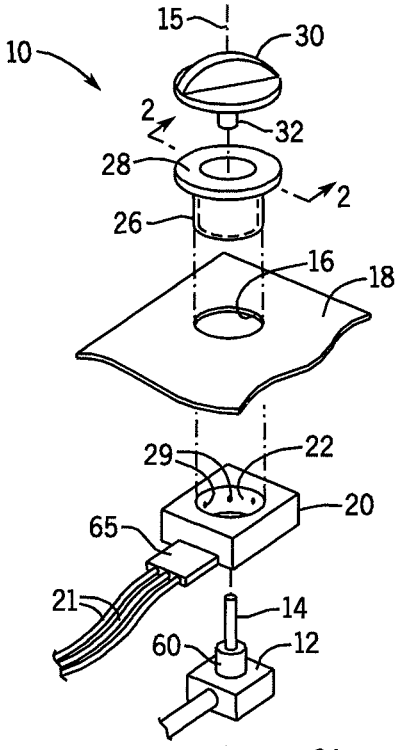
FIG. 1 is an exploded view of the illumination system of the present invention providing a housing mounted to the rear of the console and receiving an annular light pipe inserted into the housing from a front side of the console, the annular light pipe fitting around a gas valve or the like to provide backlighting to a knob controlling the gas valve.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, a control 10 for an appliance or the like may provide, for example, a gas valve 12 having a shaft 14 extending along axis 15 through an opening 16 in a console 18 of the appliance. Lighting circuitry housing 20 may be positioned at the rear of the console 18 and, in one embodiment, may be connected with connecting conductors 21 or the like to an electrical source or other similar housing 20 and central controller (not shown). The lighting circuitry housing 20 may further provide for an opening 22 through which the shaft 14 may extend as it passes through the console 18.

An annular light pipe 24 having a generally cylindrical tubular portion 26 terminates in a radially outwardly extending lip 28. The annular light pipe 24 may be positioned on the outside of the console 18 with a rear surface of the lip 28 abutting a front surface of the console 18 and the tubular portion 26 may fit through the opening 16 in the console 18 to be received within the opening 22 in the lighting circuitry housing 20. A series of electrical lamps 29, for example surface mount light emitting diodes (LEDs), may face radially inward and around the opening 22 within the lighting circuitry housing 20 to project light into the tubular portion 26 to be conducted upward to the lip 28.

A control knob 30 may fit over the lip 28 and may have a socket 32 receiving the shaft 14 to allow manipulation of the latter by the operator grasping the knob 30 and rotating it about the axis 15. In one embodiment, the radially outwardly extending lip 28 may be circular in periphery and have a diameter approximately equal to or less than a diameter of the knob 30 so as to fit wholly behind the knob 30.

Figure 2:
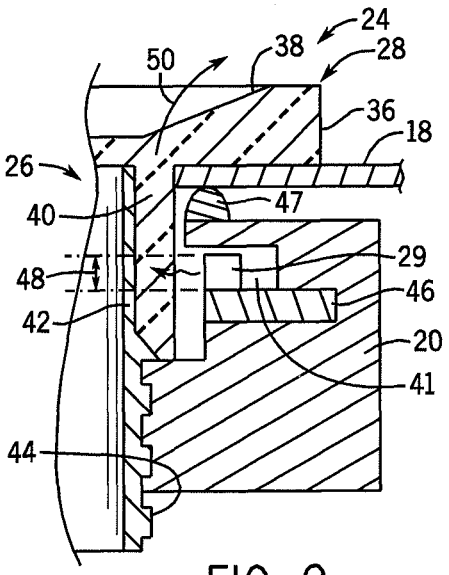
FIG. 2 is a cross-section along line 2-2 of FIG. 1 showing engagement between the annular light pipe and housing for a first console thickness as controlled by helical threads.

Referring now to FIG. 2, lip 28 may be constructed of a transparent or tinted thermoplastic providing a light spreader 38 that will project light radially outward and axially outward toward the user. The light spreader 38 is optically coupled with a corresponding transparent cylindrical annulus 40 extending down along the outside of the tubular portion 26 to be exposed along its outer surface for the receipt of light. The tubular portion 26 may further include an opaque and/or reflective inner wall 42 that extends within and below the transparent cylindrical annulus 40 to provide a series of outwardly facing teeth 44, implementing in the embodiment shown as helical threads engaging the corresponding mating threads on the lighting circuitry housing 20. The light pipe 24 may move axially with respect to the lighting circuitry housing 20 to position the lip 28 tightly against the outer surface of the console 18 by rotation of the light pipe 24. This axial motion compresses the console 18 between the lower surface of the lip 28 and a compression stop 47 on the upper surface of the lighting circuitry housing 20 holding the housing 20 and light pipe 24 tightly in position. In this position, LEDs 29 on a printed circuit board 46 within the lighting circuitry housing 20 and facing radially inward around the opening 22 may project light into a first portion 48 of the transparent cylindrical annulus 40 where the light is conducted by internal reflection upward and outward as indicated generally by arrow 50.

Referring also to FIG. 5, the housing 20 provides a pocket 41 about the LED 29 that may provide for a reflective inner surface to help direct light toward the cylindrical annulus 40.

Figure 3:
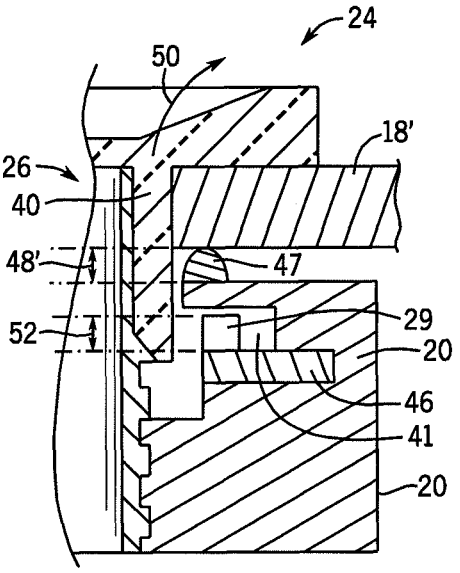
FIG. 3 is a figure similar to that of FIG. 2 showing engagement between the annular light pipe and the housing for a second console thickness.

Referring now to FIG. 3, for a different console 18' having a greater thickness than console 18, the light pipe 24 may be moved away from the lighting circuitry housing 20 to accommodate the greater thickness of console 18' so that the LEDs 29 project light into a second portion 52 of the transparent cylindrical annulus 40 providing similar light output as indicated by arrow 50. The second portion 52 may be axially or rotationally displaced with respect to the first portion 48 without changing the separation between the outer surface of the transparent cylindrical annulus 40 and the LEDs 29 thus providing improved light consistency and optical coupling when the light pipe 24 is so moved.

The radial thickness of the transparent cylindrical annulus 40 may be quite thin compared to the area of light projection of the LED 29 enhancing internal reflection within the transparent cylindrical annulus 40 and allowing reduced obstruction of the opening 16 by the light pipe 24 as promotes air influx in a gas valve design as will be described below. In one embodiment, console thicknesses may vary between 1 mm and 4 mm and yet still be accommodated in this manner.

Referring now to FIGS. 2 and 4, as noted above, the LEDs 29 may be mounted on a planar printed circuit board 46 arranged about an aperture 51 that may accept the cylindrical annulus 40. The LEDs 29 may be oriented to emit light parallel to the surface of the printed circuit board on which they are mounted. Printed circuit board 46 may also support other circuitry interconnected by conductive traces and may provide for connection to the conductors 21 (shown in FIGS. 1 and 6). In one embodiment, every other LED 29 may be a different color from its neighbors (for example alternating white and amber LEDs) and the LEDs 29 may be connected so that the different colors may be independently illuminated.

Referring now to FIG. 6, multiple controls 10, 10' may receive a common power line 21*a* being one of the conductors 21 and may provide individually for various control lines 21*b*, 21*c* providing control, for example, of the color of the LEDs 29 being illuminated. These control lines 21*b*, 21*c* may connect with a controller 53 that may also receive signals from a switch (not shown) associated with the gas valve 12 so that the colors of the LEDs 29 may be adjusted to indicate whether the valve 12 is open or closed (and/or possibly the degree of opening of the valve 12) to provide a visual indication to the consumer of which burners are active. The controller 53 may include a processor 55 executing a stored program 56 for this purpose, as is understood in the art.

Referring still to FIG. 6 and also to FIG. 1, the lip 28 of the light pipe 24 may provide for a central bore 58 fitting around a sleeve 60 surrounding the shaft 14 on the valve 12 to accurately position the lip 28 concentrically about the shaft 14. Opposed, arcuate air vent apertures 62 may surround the bore 58 to provide for intake of air necessary for the operation and air mixing element of the gas valve 12. These apertures 62 may in turn be surrounded by a ring 64 providing the outer circular periphery to the lip 28 and, on a lower surface, an attachment circle for the upper end of the transparent cylindrical annulus 40.

Referring now to FIG. 7, in an alternative embodiment, the LEDs 29 may emit light perpendicularly to the surface of the printed circuit 46' and the printed circuit board 46' may be a flexible printed circuit board rolled to form a semi-cylinder around the outside of the transparent cylindrical annulus 40. The flexible printed circuit board 46' may be connected directly to a connector block 65 providing an alternative electrical connection means. In both the embodiments of FIG. 4 and FIG. 7, the printed circuit board may be coated with a reflective material to improve the direction of light to the cylindrical annulus 40.

Referring now to FIG. 8, in an alternative embodiment, the housing 20 may provide for a downwardly extending ratchet pawl 70 that may in turn engage with corresponding ratchet teeth 72 so that the light pipe 24 may be pressed downward toward the housing 20 without rotation and locked in that downward position by engaging ratchet teeth 72 and pawl 70.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

References to "a controller" and "a processor" can be understood to include one or more controllers or processors that can communicate in a stand-alone and/or a distributed environment(s), and can thus be configured to communicate via wired or wireless communications with other processors, where such one or more processor can be configured to operate on one or more processor-controlled devices that can be similar or different devices. Furthermore, references to memory, unless otherwise specified, can include one or more processor-readable and accessible memory elements and/or components that can be internal to the processor-controlled device, external to the processor-controlled device, and can be accessed via a wired or wireless network.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. An illuminator for an appliance control, the appliance control having a shaft that may extend through an opening in a console to be received by a knob on a front surface of the console, the illuminator comprising:

a light pipe having a first portion adapted to fit beneath the knob on the front surface of the console with a second portion passing through the opening with the shaft and presenting a light-receiving surface extending within the console;

a housing positionable adjacent to the opening on a rear surface of the console to receive and retain the second portion of the light pipe, the housing holding a plurality of electrical lamps positioned to project light into the light-receiving surface when the light- receiving surface is so received and to capture the console between the housing and light pipe;

wherein the second portion of the light pipe may be adjusted to and retained at multiple different positions within the housing to accommodate consoles of different thicknesses while maintaining a substantially constant separation between the electrical lamps and the light-receiving surface.

2. The illuminator of claim 1 wherein the first portion of the light pipe provides a clamping surface abutting the front surface of the console and wherein the second portion of the light pipe and the housing provide mutually engaging teeth permitting a clamping of the console between the clamping surface of the first portion and a front surface of the housing.

3. The illuminator of claim 2 wherein the front surface of the housing includes a resilient pad compressible during clamping.

4. The illuminator of claim 2 wherein the mutually engaging teeth are threads.

5. The illuminator of claim 2 wherein the mutually engaging teeth are ratchet teeth and a pawl.

6. The illuminator of claim 1 wherein the first portion of the light pipe has a circular periphery encircling a central bore through which the shaft may pass.

7. The illuminator of claim 6 wherein a diameter of the circular periphery is less than or equal to a diameter of an outer periphery of the knob.

8. The illuminator of claim 6 wherein the first portion of the light pipe provides a transparent periphery and upper surface permitting light to pass therethrough.

9. The illuminator of claim 6 wherein the second portion of the light pipe is a tube fitting about the shaft.

10. The illuminator of claim 1 wherein the second portion of the light pipe provides an opaque coating opposite the light-receiving surface.

11. The illuminator of claim 1 wherein the electrical lamps are light emitting diodes.

12. The illuminator of claim 1 wherein the electrical lamps are light emitting diodes of two colors wired for separate control.

13. The illuminator of claim 1 wherein the electrical lamps are supported on a planar printed circuit board fitting within the housing about an aperture receiving the second portion of the light pipe, and the electrical lamps are positioned on the printed circuit board to direct light inward radially toward a center of the aperture.

14. The illuminator of claim 1 wherein the electrical lamps are supported on a flexible printed circuit board fitting within the housing about an aperture receiving the second portion of the light pipe, and wherein the electrical lamps are LEDs mounted on a surface of the printed circuit board and wherein the printed circuit board is formed into a ring about the aperture so that the LEDs face inward toward the second portion of the light pipe.

15. The illuminator of claim 1 wherein the light pipe provides a central aperture for receiving the shaft and at least one second aperture for providing air inflow through the console.

16. The illuminator of claim 1 wherein the second aperture is within a tube forming the second portion of the light pipe.

17. The illuminator of claim 1 wherein electrical lamps are mounted adjacent to a reflective surface directing light toward the second portion of the light pipe.

18. A method of indicating operation of a burner on a cooktop, the burner controlled by an appliance control having a shaft that may extend through an opening in a console to be received by a knob on a front surface of the console, the method comprising the steps of (a) fitting a first portion of a light pipe beneath the knob on the front surface of the console to extend a second portion of the light pipe through the opening with the shaft to provide a light-receiving surface extending within the console;

(b) positioning a housing adjacent to the opening on a rear surface of the console to receive and retain the second portion of the light pipe, the housing holding a plurality of electrical lamps positioned to project light into the light-receiving surface when the light-receiving surface is so received and to capture the console between the housing and light pipe:

(c) sliding the second portion of the light pipe within the housing to fit a thickness of the console and be retained by the housing while maintaining a substantially constant separation between the electrical lamps and the light-receiving surface.

19. The method of claim 18 wherein the electrical lamps include lamps of a first and second color and further including the step of (d) illuminating lamps of the first color with a first setting of the appliance control and illuminating lamps of the second color with a second setting of the appliance control.

20. The method of claim 18 wherein the appliance control is a gas valve controlling gas to a cooktop and the first setting of the appliance control is off and the first color of lamps is white and the second setting of the appliance control is on and the second color is selected from the group consisting of: red, orange, and yellow.

* * * * *